United States Patent [19]

Scocca

[11] Patent Number: 4,503,785

[45] Date of Patent: Mar. 12, 1985

[54] METHOD FOR REDUCTION OF SULFUR CONTENT IN EXIT GASES

[76] Inventor: Peter M. Scocca, P.O. Box 876, Lilburn, Ga. 30247

[21] Appl. No.: 467,152

[22] Filed: Feb. 17, 1983

Related U.S. Application Data

[63] Continuation of Ser. No. 159,457, Jun. 16, 1980, abandoned.

[51] Int. Cl.[3] ..... F23J 11/07; C10L 10/04

[52] U.S. Cl. ..... 110/342; 44/1 SR; 44/4; 431/2; 110/345

[58] Field of Search ..... 44/1 SR, 4, 5, 6, 26, 44/50, 51; 110/345, 342; 423/244; 431/3, 2, 4

[56] References Cited

U.S. PATENT DOCUMENTS

| | | | |
|---|---|---|---|
| 1,609,059 | 11/1926 | Claus | 44/5 |
| 2,014,686 | 9/1935 | Lubovitch et al. | 44/4 |
| 2,204,148 | 6/1940 | Nelms | 44/4 |
| 3,488,129 | 1/1970 | Itoh | 431/4 |
| 3,909,212 | 9/1975 | Schroeder | 44/1 SR |
| 3,948,617 | 4/1976 | Withorn | 44/4 |
| 4,226,601 | 10/1980 | Smith | 44/1 SR |
| 4,230,460 | 10/1980 | Maust, Jr. | 44/1 SR |
| 4,235,585 | 11/1980 | Anderson | 431/4 X |
| 4,262,610 | 4/1981 | Hein et al. | 110/342 |

FOREIGN PATENT DOCUMENTS

| | | | |
|---|---|---|---|
| 42367 | 12/1981 | European Pat. Off. | 44/1 SR |
| 1303552 | 1/1973 | United Kingdom . | |

*Primary Examiner*—Carl F. Dees

*Attorney, Agent, or Firm*—Louis T. Isaf

[57] ABSTRACT

A method for reducing the emissions of sulfur dioxide and sulfur trioxide in exit gases resulting from the burning of sulfur bearing fuels, which includes the step of igniting alkaline earth metals simultaneously with the igniting of the fuel. The method provides for the burning of high sulfur content fuels while maintaining strict environmental emission requirements established for lower sulfur content fuels.

5 Claims, 1 Drawing Figure

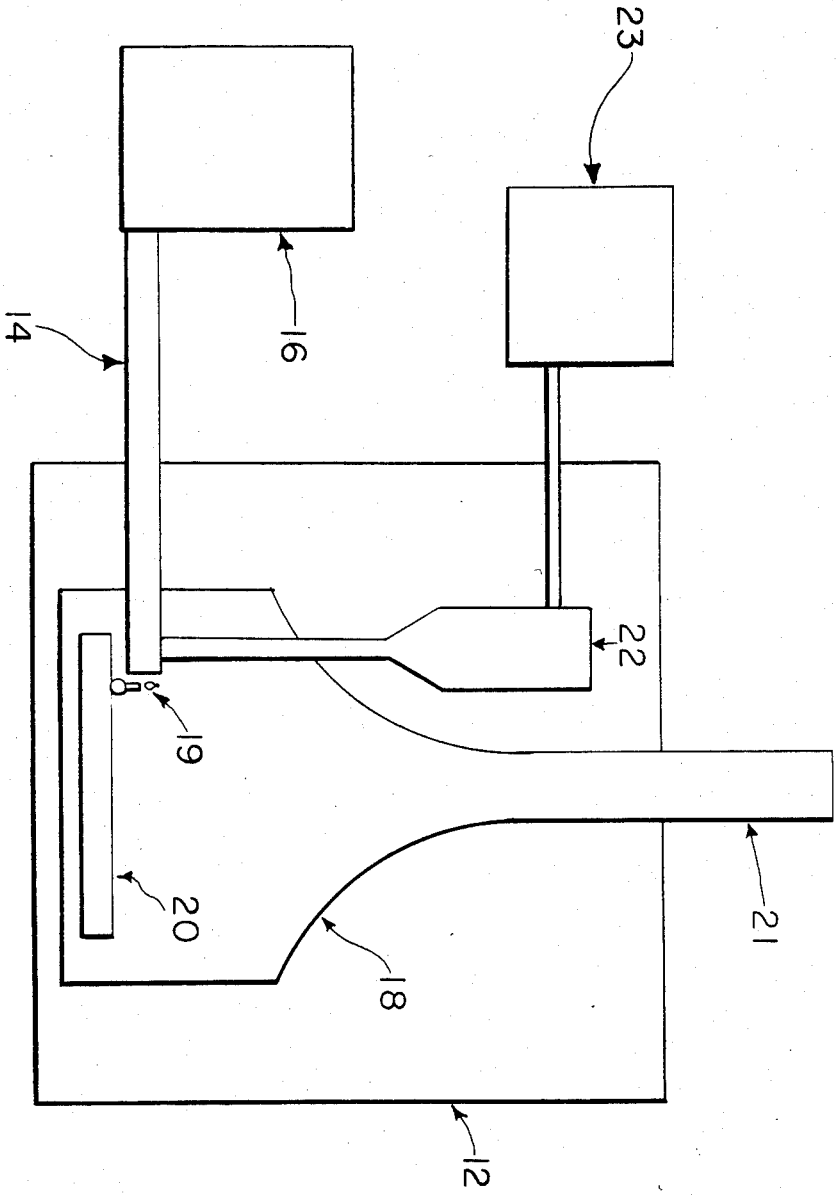
23
22
21
16
14
19
20
18
12

METHOD FOR REDUCTION OF SULFUR CONTENT IN EXIT GASES

CONTINUATION

The present application is a continuation of pending application, Ser. No. 159,457, filed June 16, 1980 and now abandoned, the filing date of which is claimed for the subject matter of herein under 35 USC 120.

FIELD OF THE INVENTION

The present invention relates generally to the field of pollution control and more specifically to the reduction of sulfur dioxide and sulfur trioxide emissions in exit gases from combustion systems.

BACKGROUND OF THE INVENTION

Society has become increasingly aware of the existence of the dangers of pollution in all areas of life and great emphasis has been placed on the curbing of pollution. One targeted area of pollution has been the emissions from industrial and utility combustion plants. Federal and State Government agencies have established regulations governing the emission of sulfur dioxide and sulfur trioxide in exit gases from combustion systems. These regulations have included the establishment of maximum level requirements of the sulfur dioxide and sulfur trioxide content in the exit gases. For example, one such regulation (at the time of this writing) requires that exit gases contain 0.2 lbs. or less of sulfur dioxide per million British Thermal Units (BTUs) in the fuel. Prior to the present invention, these standards (level requirements) have prompted experts to seek the use of low sulfur content fuels or to install expensive scrubbers, or both.

In some areas, the state, and/or federal agencies responsible for the control of emission levels obtained legislation regulating the sulfur content of the fuels to be burned. This legislation has demanded the burning of the low sulfur content fuels and has imposed the regulation on both buyers and sellers of fuels. The low sulfur content fuels require special processing by suppliers. The significantly higher costs for the lower sulfur content fuels are reflected in the higher costs to all consumers. The continually increasing costs for low sulfur content fuels have been an inducement to utilities and others using those fuels to find methods for improving overall efficiencies which would reduce the total cost for generating power.

High sulfur content fuels are significantly less expensive than low sulfur content fuels; high sulfur content fuels are more readily and easily available; and high sulfur content fuels have significantly higher heating values than do low sulfur content fuels. In an attempt to allow the use of high sulfur content fuels, the regulatory agencies have established programs requiring the use of scrubbing systems designed to remove the objectionable sulfur dioxide and sulfur trioxide components in the exit gases. These scrubbers are required in installations burning fuels at 250 million BTUs per hour or higher, and where the exit gases contain more than 0.2 lbs of sulfur dioxide per million British Thermal Units in the fuel. The scrubbers have high maintenance costs and require special handling of the extracted products. The scrubber units are estimated to cost between 70–100 million dollars each depending upon the systems to which they are attached. The regulations governing the use of scrubbers apply to new installations. Existing installations must be operated at the Environmental Protection Agency (EPA) designated emission levels. This significant increase in the capital investment is passed on to the consumer in the form of higher power costs. The net effects of the overall emission control and regulation, apparently, have been significantly higher fuel costs, reduced heating values of the fuels required to be used, and higher costs for generating power.

SUMMARY OF THE INVENTION

Briefly described, the present invention comprises a method of reducing the sulfur dioxide and sulfur trioxide content in the emission gases of combustion systems typically found utilized in industrial and utility plants. The invented method includes the igniting of calcium nitrate with sulfur bearing fuels or products. Embodiments of the present invention include the burning of high sulfur content fuels and a calcium nitrate solution and maintaining low emission levels of sulfur dioxide and sulfur trioxide in the exit gases.

The calcium nitrate is metered into the fuel system at a point in time prior to actual ignition of the fuel and at a predetermined rate which may be varied to satisfy the reduction levels desired by the user. The fuel and calcium nitrate are ignited simultaneously and, during the igniting and burning process, the calcium nitrate reacts with the sulfur and oxygen present to form calcium sulfates thus preventing large quantities of sulfur from forming sulfur dioxide and sulfur trioxide.

It is, therefore, an object to the present invention to provide an easy, economical method for reducing the emissions of sulfur dioxide and sulfur trioxide in the exit gases.

Another object of the present invention is to provide a method for the burning of high sulfur content fuels while maintaining required low levels of sulfur dioxide and sulfur trioxide contents in exit gases.

Yet another object of the present invention is to provide a sulfur bearing fuel combustion system which produces exit gases including emission levels of less than or equal to 0.2 lbs of sulfur dioxide per milion BTUs of fuel and thus eliminating the need for purchasing and maintaining expensive scrubber units.

Still another object of the present invention is to provide a combustion system which makes effective use of existing fuel resources (such as high sulfur bearing fuels), reduces the need for fuel suppliers to produce expensive low sulfur content fuels, reduces fuel costs to utilities and industry, provides savings which can be passed on to consumers, and reduces sulfur pollutants in the air.

Other objects, features and advantage of the present invention will become apparent upon reading and understanding the remaining specification.

BRIEF DESCRIPTION OF THE DRAWING

The FIGURE is a representative schematic of a power generating plant utilizing the method of the present invention.

DETAILED DESCRIPTION OF PREFERRED EMBODIMENT

Referring now in greater detail to the drawing, the FIGURE depicts a preferred embodiment of the process of the present invention. The present invention relates to a unique and inventive application of calcium nitrate in power generating units 12 and other combustion systems to reduce the harmful pollutants resulting from the burning of sulfur bearing fuels and other sulfur bearing products.

The power generating unit 12 is of a type typically found in utility and industrial plants at the time of this invention. Actually, this unit 12 with the exception of various improvements in control procedures has not changed from that which was used with the first boilers.

The burning chamber is open to the atmosphere through various ducts and passages. An ignitable fuel is pumped into the burner. In addition to the fuel, air is blown into the burner area. Most utility and industrial size boilers will have both primary and secondary air supplies providing an abundance or, more correctly, an excess of oxygen to the system. The system has a constant or continuous open flame 19 and a constant or continuous excess air flow. In most instances the air has been preheated and is supplied to the burner section by a series of both forced draft and induced draft fans. The combustion area 18 in the boiler must have excess oxygen for maintaining the normal air flow system and proper ignition of the fuel as observed in the open flame 19. The concept of open flame burning is a basic operation in the utility and industrial size boilers (power units) 12 of the type utilized in the preferred embodiments of this invention. In general, fuel oil or a combustible fuel (including, for example, coal) is ignited in an open chamber 18 containing an abundance of air. In some instances additional air is added immediately into the flame area as well as around the flame area. As needed to maintain the standard operational requirements of the utility or industrial size boiler, the volume of the air can be changed. However, there must always be an excessive abundance of air in order to provide for the volume requirements in the utility and industrial size boilers. Information of the type indicated above can be found in a reference book from the Babcock and Wilcox Company, 39th edition of "Steam", copyright 1978. Further references are available from a John Wiley and Sons publication, "Unit Operations", copyright 1950.

Sulfur bearing fuel oil or other sulfur bearing products are fed through feed lines 14 from their storage reservoir 16 to the combustion chamber 18 of a power generating unit 12. As the fuel enters the combustion area it is ignited through any one of various systems commonly used in the utility or industrial boilers. Burners introduce fuel and air mixtures into the furnace or combustion zone. This maintains the exothermic chemical reactions for the most effective release of heat. Combustion air is usually pre-heated and delivered to the burners by a system of fans and ducts. It is necessary to supply more than the theoretical air quantity to assure complete combustion of the fuel in the furnace or combustion zone. In some instances steam is used for atomizing the fuel. In other systems the pressure of the fuel being pumped into the system is used as a means of atomization. Special lighters or igniters are used to ignite the main fuel. This ignition system for the main streams of gas or fuel oil can be either a spark device or a light oil ignition system, which itself is ignited. There are special and different type ignitions systems for use in utility or industrial size boilers burning pulverized coal. In a traveling grate or bed type coal fired boiler a different type but essentially the same concept of ignition is used, except that the coal is then deposited on a burning and usually traveling grate or bed. In accordance with the present invention, as the fuel approaches the combustion point 19, a quantity of calcium nitrate is injected into the feed line 14 and thus into the fuel stream. The injection of calcium nitrate to the fuel is done preferably immediately prior to the combustion point 19. The alkaline earth metal nitrates and the sulfur bearing fuel are ignited simultaneously at the combustion point. The calcium nitrate, in the presence of the heat of the buring fuel, reacts with sulfur of the fuel oil and oxygen to form calcium sulfates which generally fall out of the combustion site into waste bins 20. As more sulfur is used up in the formation of sulfates, less sulfur remains to escape through the exhaust pipes or stacks 21 in the form of oxides, i.e. sulfur dioxide and sulfur trioxide.

The calcium nitrate [$Ca(NO_3)_2$) reacts with the sulfur in the fuel as seen in the following chemical formulations:

$$S + O_2 \rightarrow SO_2$$

$$2SO_2 + O_2 \rightarrow 2SO_3$$

$$SO_3 + H_2O \rightarrow H_2SO_4$$

$$SO_2 + H_2O \rightarrow H_2SO_3$$

$$2H_2SO_3 + O_2 \rightarrow 2H_2SO_4$$

$$2Ca(NO_3)_2 \xrightarrow{\Delta} 2Ca(NO_2)_2 + 2O_2$$

$$Ca(NO_2)_2 \xrightarrow{\Delta} CaO + N_2O_3 + O_2$$

$$CaO + H_2SO_4 \rightarrow CaSO_4 + H_2O$$

For purposes of this invention, the calcium nitrate ignited with the fuel is either in a dry power (solid) state or in a liquid state. In the preferred embodiment, the alkaline earth metal nitrate is placed in a liquid state, solution, emulsion, or dispersion, prior to mixing with the fuel. Most preferably, the compound is in aqueous solution, although any suitable solvents or emulsifiers other than water are contemplated hereby.

With reference again to the FIGURE, the calcium nitrate, preferably in the form of an aqueous solution of calcium nitrate, is stored in a metering tank 22 from which the solution is metered into the fuel line 14. Where large quantities of the solution must be used, the solution is held in a holding tank 23 from which it is pumped to the metering tank 22. The solution is metered into the fuel line 14 at the point of combustion 19 or just prior to the point of combustion at a variable rate based on a unit quantity of sulfur bearing fuel or other sulfur bearing product and on the amount of reduction desired in the sulfur dioxide and sulfur trioxide in the exit gases.

Although the preferred embodiment calls for metering calcium nitrate into the system at the point of combustion or immediately prior thereto, it is within the scope of this invention to "pretreat" the fuel or other sulfur bearing product. That is, the calcium nitrate, in its appropriate form, is injected into the liquid fuel (or dispersed onto a solid fuel) at any time prior to ignition, even for example, while the fuel is in the storage reservoir 16.

Whereas some references in this disclosure may discuss the present invention in terms relating to the treatment of liquid fuels and products, no limitations are intended thereby. Rather, the fuel and sulfur bearing products discussed herein expressly include solid fuels and products, such as sulfur bearing coal. The term "injecting into the fuel", shall be read to include the "dispersing onto" solid fuels. "Fuel Stream" and "fuel line" shall be read to include the appropriate reference to handling of solid fuels.

EXAMPLES

Applicant offers the following examples as samples of the invention process, depicting a preferred embodiment.

PREAMBLE: #6 fuel with 1.8% sulfur content was ignited and burned at a rate of twenty-four (24) gallons per minute (1440 gal/hr) in typical manner known in the art, in a power unit of a generating station. The power units 12, used in the examples, have air volumes in the range of 300,000 cubic feet per minute. The power unit was operated at full power, and exit gases were exhausted into and through the station's exhaust stack. For purposes of later comparison, repeated samplings and analysis of the exhaust gases were made at a point half-way up the stack. The analysis of the exit gases resulting from the fuel burned in accordance with the prior art methods showed consistently similar measurements of the total sulfur ($SO_2+SO_3$) content of the exit gases, which averaged to approximately 2.69 mg sulfur ($SO_2+SO_3$) per 15 liters of exit gas.

EXAMPLE 1

In accordance with the present invented process, a solution of calcium nitrate was added to and ignited with the fuel oil at a rate of (4) gallons of calcium solution per hour. The calcium solution was injected into the fuel stream, by known metering methods and devices, at a point immediately prior to the point of ignition. Metering of the calcium solution into the fuel system immediately prior to ignition aided in assuring that the solution was ignited at the same rate at which it was metered into the fuel stream. The power unit continued to operate at full power and exit gases were exhausted through the stack in the typical manner. Repeated samplings and analysis of the exit gases taken as above mentioned discloses that the fuel oil with 1.8% sulfur, burned in accordance with the method of the present invention, consistently resulted in exit gases averaging 0.19 mg sulfur ($SO_2+SO_3$) per 15 liters of exit gas.

The calcium solution of this example was 50% aqueous solution of technical grade calcium nitrate. The fifty percent aqueous solution of calcium nitrate has a PH of approximately 9.6. It has been found that the PH of the aqueous nitrate solution will vary approximately from 9.55 to 10.2, depending upon the concentration of calcium nitrate in solution. The calcium nitrate, tech., is that supplied by Hummell Chemical Company, Inc., having the chemical formula $5Ca(NO_3)_2NH_4NO_3 10H_2O$. The following chemical formulations and explanation illustrate the theoretical reactions evidenced in this example:

$$2Ca(NO_3)_2 \xrightarrow{\Delta} 2Ca(NO_2)_2 + 2O_2$$

-continued $$Ca(NO_2)_2 \longrightarrow CaO + N_2O_3 + O_2$$

$$CaO + H_2SO_4 \longrightarrow CaSO_4 + H_2O$$

$$NH_4NO_3 \xrightarrow{\Delta} N_2O + 2H_2O$$

$$2N_2O \longrightarrow 2N_2 + O_2$$

$H_2SO_4$ is formed when $SO_2/SO_3$ is in the presence of water vapor. Since both water vapor and $SO_2/SO_3$ are present upon combustion of sulfur bearing fuels, $H_2SO_2$ mist is formed as temperatures drop. When aqueous alkali metal compounds are atomized into or onto the sulfur bearing fuel at the hottest part of the flame, at combustion point, the above reactions take place almost instantanously converting the $SO_2/SO_3$ into neutral alkali sulfate as a dense precipitating particulate.

EXAMPLE 2

The calcium nitrate solution of Example 1, at a rate of six (6) gallons per hour, and the #6 fuel oil with 1.8% sulfur, at a rate of 1416 gallons per hour, were burned together in the power unit operating at full power. Samplings and analysis disclosed a sulfur content in the exit gases of approximately 0.058 mg. sulfur ($SO_2+SO_3$) per 15 liters of exit gas.

EXAMPLE 3

Example 2, above, was repeated this time igniting and burning two (2) gallons per hour of the calcium nitrate solution together with the #6 fuel oil with 1.8% sulfur at 1416 gallons per hour. The analyzed sulfur content of the exit gases was approximately 0.33 mg. sulfur ($SO_2+SO_3$) per 15 liters of exit gas.

To emphasize the impact of the present invention, the sulfur content of the exit gases in the above examples will be converted to pounds of sulfur dioxide per million BTUs in the fuel. This is the measurement used by the U.S. Environmental Protection Agency which has set a maximum content for new facilities at 0.2 lbs. SO/10 BTU. Using a common conversion factor computed for the power unit used in Examples 1, 2 and 3 and established on the worst possible conditions as 100% conversion of sulfur in the fuel to sulfur dioxide, the following figures (in specific units previously described) are computed and compared:

| | | |
|---|---|---|
| prior art methods | (approx) | 1.8550 lbs $SO_2/10^6$ BTU |
| Example 3 | (approx) | 0.2299 lbs $SO_2/10^6$ BTU |
| EPA maximum | (approx) | 0.2000 lbs $SO_2/10^6$ BTU |
| Example 1 | (approx) | 0.1322 lbs $SO_2/10^6$ BTU |
| Example 2 | (approx) | 0.0404 lbs $SO_2/10^6$ BTU |

The sulfur dioxide content was calculated on the basis of factors derived from a calculated quantity of sulfur in the fuel, namely 0.9203 lbs. of sulfur per million British Thermal Units of fuel which is equivalent to 1.8406 lbs. of sulfur dioxide per million BTUs of fuel.

Whereas the present invention has been described in specific detail with particular reference to preferred embodiments thereof, it will be understood that variations and modifications can be effected within the spirit and scope of the invention as described hereinbefore and as defined in the appended claims.

I claim:

1. A method of reducing the sulfur content of exit gases exhausted from the burning chamber of an industrial boiler of a power generating plant and the like having an open flue and in which sulfur-bearing fuels are burned, said method comprising the steps of:

continuously moving a stream of sulfur-bearing fuel into the burning chamber;

adding to the stream of fuel prior to the fuel entering the burning chamber an aqueous solution of calcium nitrate so that the fuel and the calcium nitrate solution move together into the buring chamber;

igniting the sulfur-bearing fuel and the calcium nitrate in the buring chamber in an open flame; and reducing the amount of sulfur available for conversion to sulfur oxide gases, by reaction between the calcium nitrate solution and reactive components in the sulfur-bearing fuel.

2. The method of claim 1, wherein the step of igniting the sulfur-bearing fuel and the calcium nitrate solution in the burning chamber comprises the step of simultaneously igniting the sulfur-bearing fuel and the calcium nitrate solution at the hottest part of the flame within the buring chamber; and wherein the reaction between the calcium nitrate solution and the reactive components in the sulfur bearing fuel occurs at the instant of ignition.

3. A method of reducing the sulfur content of exit gases exhausted from the burning chamber of an industrial boiler of a power generating plant and the like having an open flue and in which sulfur-bearing fuels are burned, said method comprising the steps of:

continuously moving a stream of sulfur-bearing fuel into the burning chamber;

adding to the stream of fuel prior to the fuel entering the burning chamber an aqueous solution of calcium nitrate so that the fuel and the aqueous solution of calcium nitrate move together into the buring chamber;

igniting the sulfur-bearing fuel and the aqueous solution of calcium nitrate simultaneously at the hottest part of a flame within the burning chamber; and reducing the amount of sulfur available for conversion to sulfur oxide gases, by reaction between the aqueous solution of calcium nitrate and reactive components in the sulfur-bearing fuel at the instant of ignition.

4. The method of claim 1 or 3, wherein the step of adding to the stream of fuel prior to the fuel entering the burning chamber an aqueous solution of calcium nitrate comprises the steps of: preparing a solution consisting essentially of water and technical grade calcium nitrate; and metering the solution into the stream of fuel.

5. The method of claim 1 or 3, wherein the step of moving a stream of sulfur-bearing fuel into the burning chamber comprises the step of moving a stream of sulfur-bearing, liquid fuel into the burning chamber.

* * * * *